US005921658A

United States Patent [19]

Kovacik et al.

[11] Patent Number: 5,921,658

[45] Date of Patent: Jul. 13, 1999

[54] FLUORESCENT UTILITY LIGHT

[75] Inventors: James D. Kovacik, Brecksville; Paul S. Blanch, Broadview Heights; Stanley E. Grzywna, Elyria, all of Ohio

[73] Assignee: Alert Safety Lite Products Co., Inc., Bedford Hts, Ohio

[21] Appl. No.: 08/823,952

[22] Filed: Mar. 25, 1997

[51] Int. Cl.[6] ..... F21L 7/00; F21V 21/08

[52] U.S. Cl. ..... 362/199; 362/197; 362/260; 362/396; 362/398

[58] Field of Search ..... 362/220, 260, 362/396, 398, 198, 199, 208, 217, 223

[56] References Cited

U.S. PATENT DOCUMENTS

| | | | |
|---|---|---|---|
| D. 367,542 | 2/1996 | Kovacik et al. . | |
| 4,019,047 | 4/1977 | Frey . | |
| 4,258,414 | 3/1981 | Sokol | 362/398 |
| 4,262,327 | 4/1981 | Kovacik et al. . | |
| 4,275,435 | 6/1981 | Dorn | 362/396 |
| 4,305,120 | 12/1981 | Lacinski | 362/396 |
| 4,321,660 | 3/1982 | Sokol | 362/396 |
| 4,369,487 | 1/1983 | Carlow | 362/396 |
| 4,598,344 | 7/1986 | Nadler | 362/220 |
| 4,774,647 | 9/1988 | Kovacik et al. . | |
| 4,958,267 | 9/1990 | Baake . | |
| 4,977,489 | 12/1990 | Fung | 362/199 |
| 5,217,297 | 6/1993 | Yuen | 362/199 |
| 5,217,300 | 6/1993 | Lwery | 362/396 |
| 5,243,505 | 9/1993 | Carr . | |
| 5,245,518 | 9/1993 | Aspenwall . | |
| 5,301,093 | 4/1994 | Baggio | 362/260 |
| 5,436,815 | 7/1995 | Grooms et al. | 362/220 |
| 5,465,196 | 11/1995 | Hasenberg et al. | 362/396 |
| 5,493,482 | 2/1996 | Bowen | 362/260 |
| 5,528,477 | 6/1996 | Carmo . | |
| 5,558,425 | 9/1996 | Pons et al. | 362/220 |
| 5,568,968 | 10/1996 | Jaramillo | 362/396 |
| 5,765,941 | 6/1998 | Vest | 362/223 |
| 5,803,588 | 9/1998 | Costa | 362/217 |

*Primary Examiner*—Laura Tso
*Attorney, Agent, or Firm*—MacMillan, Sobanski & Todd, LLC

[57] ABSTRACT

A fluorescent utility light (10) includes an elongated body (11) having a light portion (11*a*) with a detented hook (18) at an upper end and a curved handle portion (11*b*) with an electrical outlet (33) at a lower end adjacent a power cord (32). A magnet (25) on a clip (21) rotatably engages a groove (20) in the body (11) for attaching the light (10) to a metallic surface. A lens (16) is releasably retained on the body (11) for easy access through an opening (11*c*) to a fluorescent lamp (40) mounted in a socket (38) retained in the body. A plurality of sawtooth ridges (42) formed on an interior of a top wall (16*c*) of the lens (16) directs light from the lamp through the top wall.

12 Claims, 3 Drawing Sheets

FLUORESCENT UTILITY LIGHT

BACKGROUND OF THE INVENTION

The present invention relates generally to portable lights and, in particular, to a fluorescent utility light.

Portable lights which can be manually moved and suspended about a work site to aid a user to obtain the best lighting conditions are well known. It has been the practice to use incandescent light bulbs, suitably encased in light guards, for this purpose. Such lights are often referred to as trouble lamps, extension lights, work lights, inspection lights, and the like, and are commonly employed by mechanics and other workers who require a concentration of lights in a frequently changing location. Such a trouble light is shown in the U.S. Pat. No. 4,774,647 to Kovacik et al.

Fluorescent lights have several advantages in use as compared with the incandescent bulbs. As an example, for the same wattage fluorescent lights usually provide more light with less glare. In the past, attempts have been made to convert portable lights such as extension lights to fluorescent tubes. However, a number of serious problems have arisen, particularly in attempting to adapt a fluorescent tube to a satisfactory portable assembly. A common complaint is that the electrical connections between a fluorescent tube and its mounting and electrical conductors are not originally, or do not long remain, sufficiently tight to provide desired electroconductivity, especially as compared to the more commonly used incandescent light bulbs. When inadequate electrical contacts occur, fluorescent tubes exhibit disproportionately high electrical resistance.

It is, of course, quite important that a fluorescent tube be firmly mounted and snugly held by its supports, especially if the tube is designed for portable use. While an incandescent bulb has a relatively large area of contact for electrical connection around its threaded base, the usual fluorescent tube has only a pair of relatively fine, fragile pins extending from opposite ends of the tube which constitute electrical terminals. In order to ensure a firm and constant electrical connection with the terminal pins, prior socket connections have been quite heavy and cumbersome. In some instances, sockets used for each set of pin terminals are mounted apart facing each other as on a single bracket somewhat longer than the fluorescent tube itself. Such sockets are usually stationary and not movable with respect to each other. This restriction often limits the manner in which the fluorescent tube can be mounted and used.

Additionally, it has been the practice to mount a ballast for the fluorescent tube in-line, that is, in the electrical cord which energizes the tube. The ballast which includes a transformer is normally quite heavy. This adds to the problems of supporting and mounting the fluorescent tube itself. Further, a ballast generates heat in use and the added heat, so generated, can be a problem when adjacent to the tube and its assembly.

These structural problems become even more acute if it is desired to construct a portable fluorescent tube assembly. Portable units are much more susceptible to rough handling. The tube assembly may be dropped or, at a minimum, subject to jarring, vibration, and the like. Such mechanical shocks tend to dislodge or momentarily interrupt an electric current to the tube pins at the opposite ends of the tube and produce a high voltage arc, thereby introducing health and safety hazards.

The U.S. Pat. No. 4,262,327 shows a portable fluorescent tube having a lens and a hook for hanging the assembly. The assembly includes a tubular envelope surrounding a standard fluorescent tube and closed by a pair of end sockets. One of the end sockets has a starter switch mounted thereon and a ballast is connected in an electrical supply line near an electrical plug. However, in order to change the fluorescent tube, such a light assembly must be disassembled.

SUMMARY OF THE INVENTION

The present invention concerns a fluorescent utility light including an elongated body having a curved handle and an upper portion with a removable transparent lens for enclosing a fluorescent lamp in a socket. A reflector in the body directs light from the lamp through a front wall and side walls of the lens. A movable hook is provided at an upper end of the body and a power cord for the lamp extends through a bottom wall of the handle. An electrical socket also is provided in the bottom wall of the handle such that an electrical cord plugged into the socket extends generally parallel to the power cord. A magnet on a clip engages a groove formed in a central portion of the body and the clip and the magnet can be rotated about the body to various detent positions. A plurality of sawtooth ridges formed on an interior surface of a top wall of the lens captures light from the lamp and directs it through the top wall of the lens.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
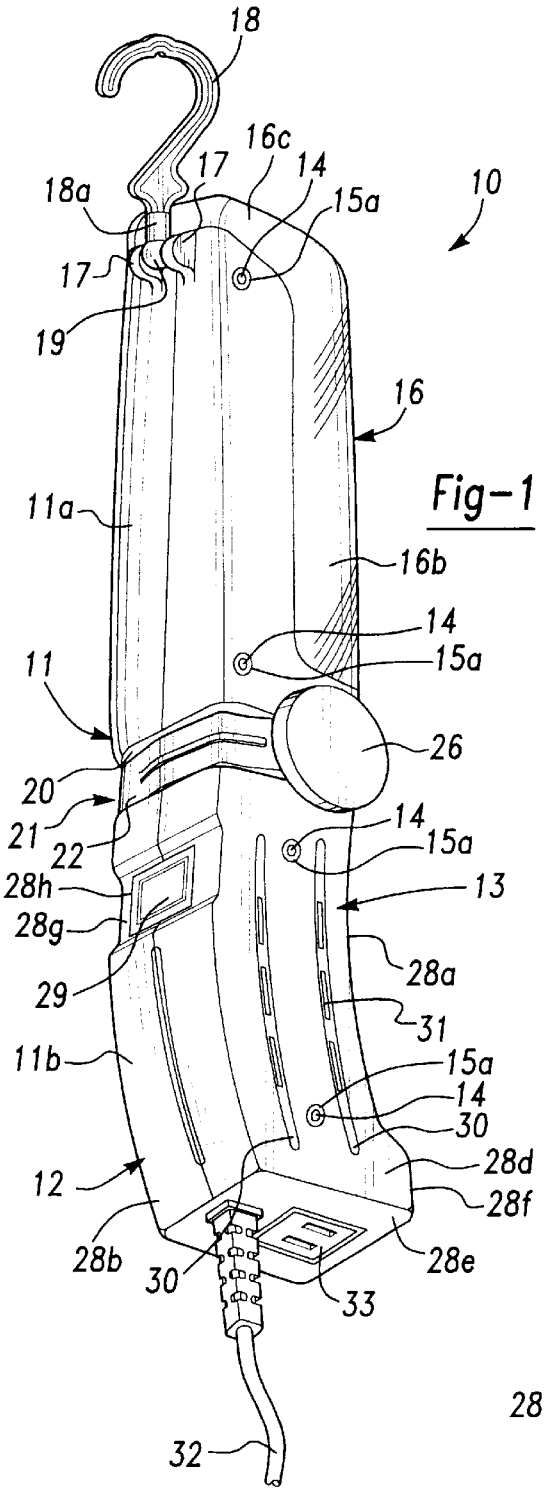
FIG. 1 is a perspective view of a fluorescent utility light in accordance with the present invention.
Figure 6:
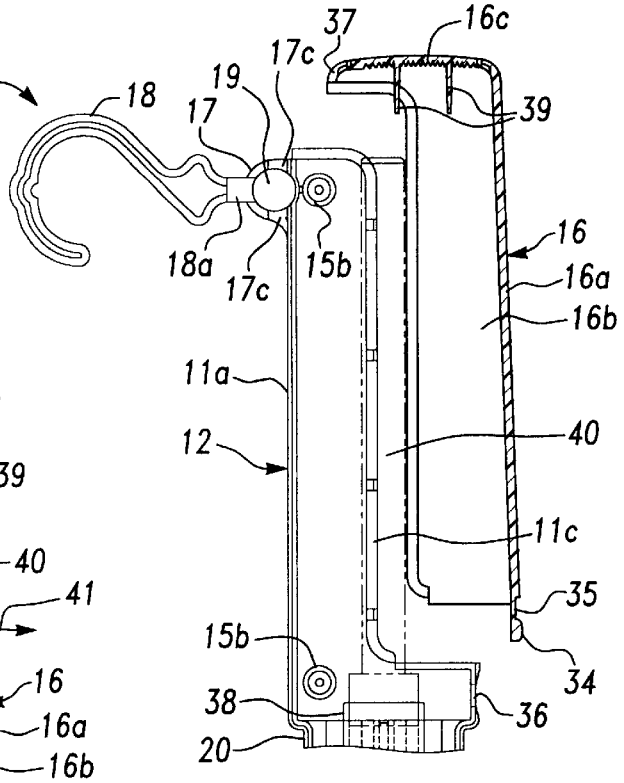
FIG. 6 is a fragmentary view of the upper portion of the utility light shown in the FIG. 5 with the lens separated from the body.
Figure 7:
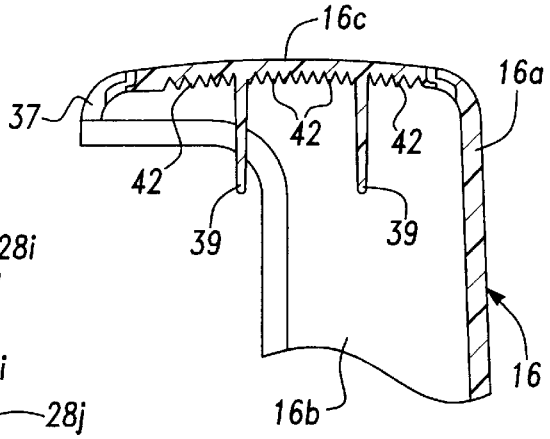
FIG. 7 is an enlarged fragmentary view of the upper portion of the lens shown in the FIG. 6.

There is shown in the FIG. 1 through the FIG. 7 a fluorescent utility light 10 in accordance with the present invention. The FIG. 1 is a perspective view of the utility light 10 showing a rear surface, a left side surface and a bottom surface thereof. The utility light 10 has an elongated hollow body 11 including an upper light portion 11*a* extending upwardly from a lower handle portion 11*b*. The body 11 is formed from a right shell 12 and a complementary left shell 13 fastened together by a plurality of threaded fasteners 14. The fasteners 14 extend through apertures 15*a* formed in the left shell 13 and threadably engage apertures formed in studs or posts 15*b* extending inside the right shell 12 (see the FIG. 5). The shells 12 and 13 retain a lens 16, as described below, which lens has transparent walls at a front wall 16*a*, a pair of side walls 16*b* and a top wall 16*c*. The lens 16 is positioned in a lens opening 11*c* (see the FIG. 6) formed in the upper light portion 11*a* of the body 11.

Extending outwardly from a rear surface of the right shell 12 and the left shell 13 near top edges thereof are a pair of horizontally spaced apart projections 17. A hook 18 has a shank portion 18*a* formed at a lower end thereof to which a ball 19 is attached. The ball 19 is movably retained between the projections 17 which, as best shown in the FIG. 3, define a gap 17*a* therebetween. Each of the projections 17 has a cup-shaped depression 17*b* formed therein facing the gap 17*a* for receiving the ball 19. The width of the gap 17*a* between the projections 17, the dimensions of the depressions 17*b* and the diameter of the ball 19 are sized to permit the ball to be retained between the projections while permitting movement of the hook 18 to various positions. The gap 17*a* is wider adjacent the body 11 to form a detent 17*c* for receiving the shank portion 18*a* of the hook 18. As shown in the FIG. 5 and the FIG. 6, the hook 18 can be moved from a fully extended upper position 18*b* shown in solid lines to a storage position 18*c* shown in phantom lines by rotating the hook in a generally vertical plane as indicated by an arrow 18*d* and rotating the hook about its longitudinal axis approximately 90° as indicated by an arrow 18*e*. In both of the positions 18*b* and 18*c*, the shank portion 18*a* is releasably retained by the detent 17*c*. Each of the projections 17 also has a detent 17 formed in the surfaces facing the gap 17*a* for cooperation with the shank portion 18*a* to retain the hook 18 in an intermediate position 18*f* midway between the extended position 18*b* and the storage position 18*c*.

Figure 4:
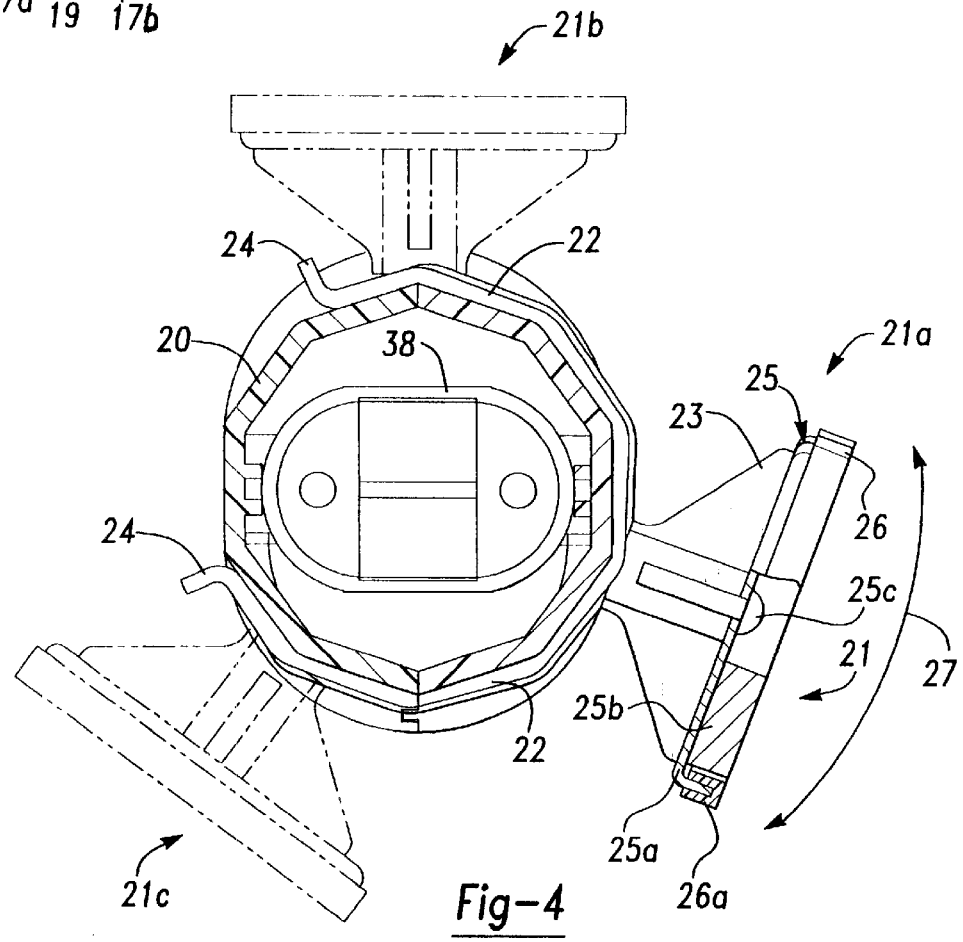
FIG. 4 is an enlarged cross-sectional view of the utility light as if taken along the line 4—4 in the FIG. 2.

At the junction of the upper light portion Ila and the lower handle portion lib, there is formed a circumferential groove 20 for retaining a light holder clip 21. As best shown in the FIG. 4, the groove 20 has a bottom wall which is decagonal in cross section. The light holder clip 21 includes a pair of legs 22 extending from a multiarm support 23. Adjacent the support 23, the legs 22 are shaped to follow the contour of the groove 20 and have spaced apart free ends 24 which are spaced apart and directed outwardly. The light holder clip 21 can be formed of a plastic material such that the legs can be spread apart to enter the groove 20 and then snapped back toward one another to retain the clip in the groove. Once engaged in the groove 20, the light holder clip 21 can be rotated about the body 11 of the light 10 as shown by an arrow 27. The legs 22 detent at any of the ten points of the groove 20, which function as ten detent positions, such as a first position 21*a* shown in solid line, a second position 21*b* shown in phantom and a third position 21*c* shown in phantom.

A disk-like magnet assembly 25 is mounted on the support 23 and retains a magnet cover 26 which can be formed of a polymer material. The magnet assembly 25 includes a cup-shaped shell 25*a* formed of a metal material and retaining an annular magnet 25*b*. The shell 25*a* can be attached to the support 23 by a threaded fastener 25*c* extending through central apertures in the shell and the magnet 25*b* to threadably engage an aperture in the support. The magnet 25*b* can be adhesively attached to the shell 25*a*. The cover 26 has a grooved periphery 26*a* which engages a peripheral wall of the shell 25*a* to enclose the magnet 25*b* without reducing the strength of the magnet for releasably holding the utility light 10 on a metallic object.

Figure 2:
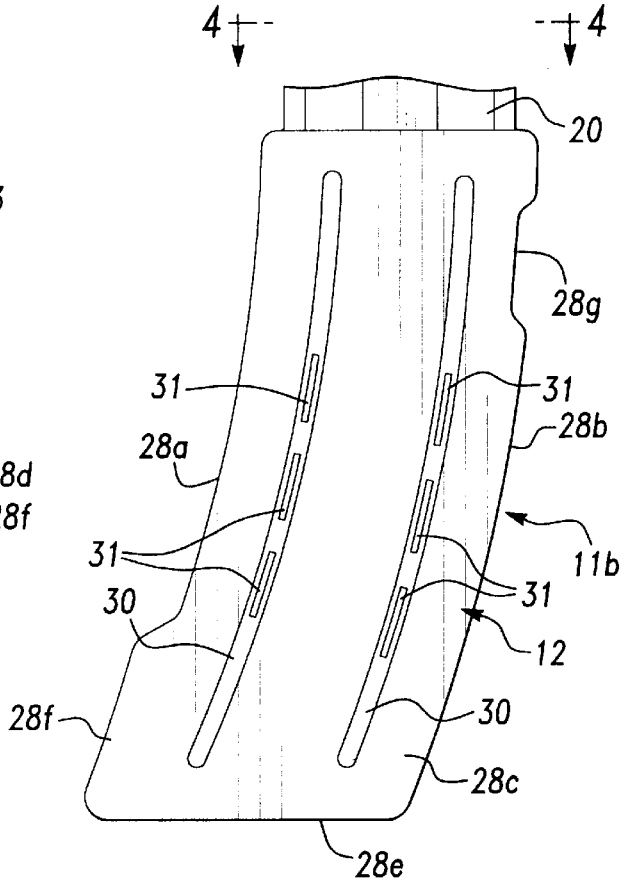
FIG. 2 is an enlarged fragmentary side elevation view of the handle of the utility light shown in the FIG. 1.

As shown in the FIG. 1 and the FIG. 2, the lower handle portion 11*b* is generally rectangular in cross section and has a front surface 28*a*, a rear surface 28*b*, a right side surface 28*c*, a left side surface 28*d* and a bottom surface 28*e*. The front surface 28*a* and the rear surface 28*b* are curved and extend generally parallel to one another to provide a convenient grip for a human hand. The front surface 28*a* has an outwardly extending projection 28*f* formed adjacent the bottom surface 28*e* as an aid in preventing the utility light 10 from slipping from the grasp of a human hand. The rear surface 28*b* has a recess 28*g* formed therein near an upper end thereof. A push button switch 29 is mounted in an aperture 28*h* (see the FIG. 5) formed in the wall of the recess 28*g* for actuation by the thumb of a human hand. The recessed switch 29 is protected from accidental actuation by being positioned below the plane of the rear surface 28*b*.

Each of the side surfaces 28*c* and 28*d* has a pair of arcuate grooves 30 formed therein extending generally longitudinally and in spaced parallel relationship. A plurality of elongated apertures 31 are formed in each of the grooves. The apertures 31 extend completely through the sidewalls 28*c* and 28*d* to provide for the circulation of cooling air to electrical components housed within the lower handle portion 11*b* and normally associated with a fluorescent light. For example, typical electrical components are shown in the U.S. Pat. No. 4,262,327 and include a suitable starter switch and ballast. The outer ends of the apertures 31 (shown in the FIG. 2) are offset relative to the inner ends of the apertures (shown in the FIG. 5) to provide a circuitous path rendering it difficult to insert a metal object through the apertures into contact with the electrical components thereby reducing the danger of electrical shock.

Figure 3:
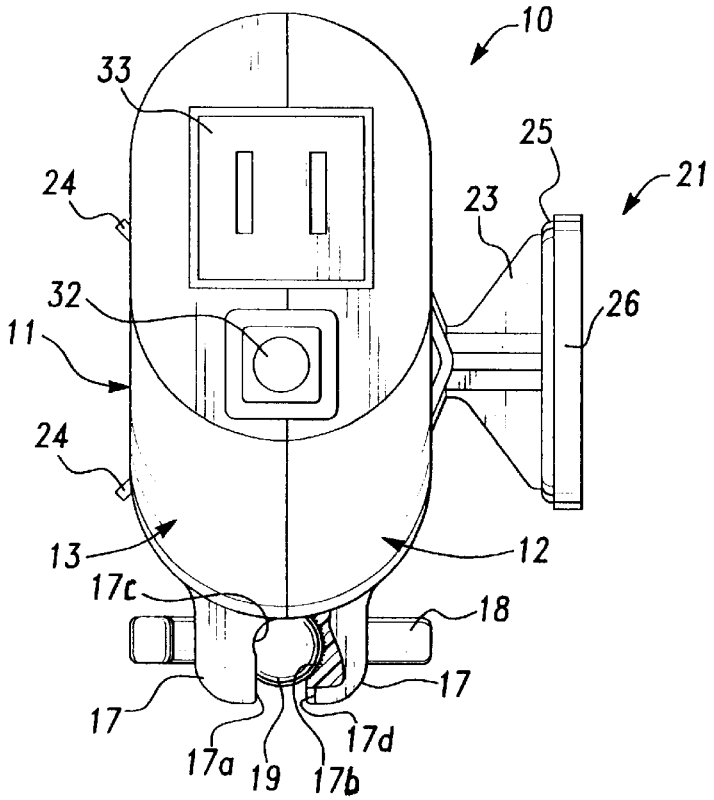
FIG. 3 is an enlarged bottom plan view of the utility light shown in the FIG. 1.

As best shown in the FIG. 1 and the FIG. 3, a power cord 32 extends from an aperture 32*a* (see the FIG. 5) formed in the bottom surface 28*e* for providing electrical power to the circuitry enclosed within the lower handle portion 11*b*. Although not shown, the opposite end of the power cord 32 has a male plug for insertion into a female electrical power receptacle. Also provided in the bottom surface 28*e*, is a female electrical receptacle 33 mounted in an aperture 33*a* (see the FIG. 5). The receptacle or socket 33 typically is connected through the push button switch 29 to the power cord 32 such that electrical power is available at the receptacle 33 only when the light 10 is turned on. The electrical socket 33 can be utilized to receive an electrical plug at the end of a power cord for an electrically powered tool or another light fixture. The adjacent location of the power cord 32 and the electrical socket 33 on the bottom surface 28*e* enables the power cord 32 and an electrical cord plugged into the socket 33 to extend generally parallel to one another thereby making it easier to move and use the fluorescent utility light 10 from place to place. As shown in the FIG. 5, a plurality of posts 28*i* extend from an inner surface of the lower handle portion 11*b* for supporting a ballast (not shown). Also extending from the inner surface of the lower handle portion 11*b* is a plurality of generally right-angle stops 28*j* adjacent each of the posts 28*i* for engaging corners of the ballast such that the posts and the stops cooperate to retain the ballast in the body 11.

Figure 5:
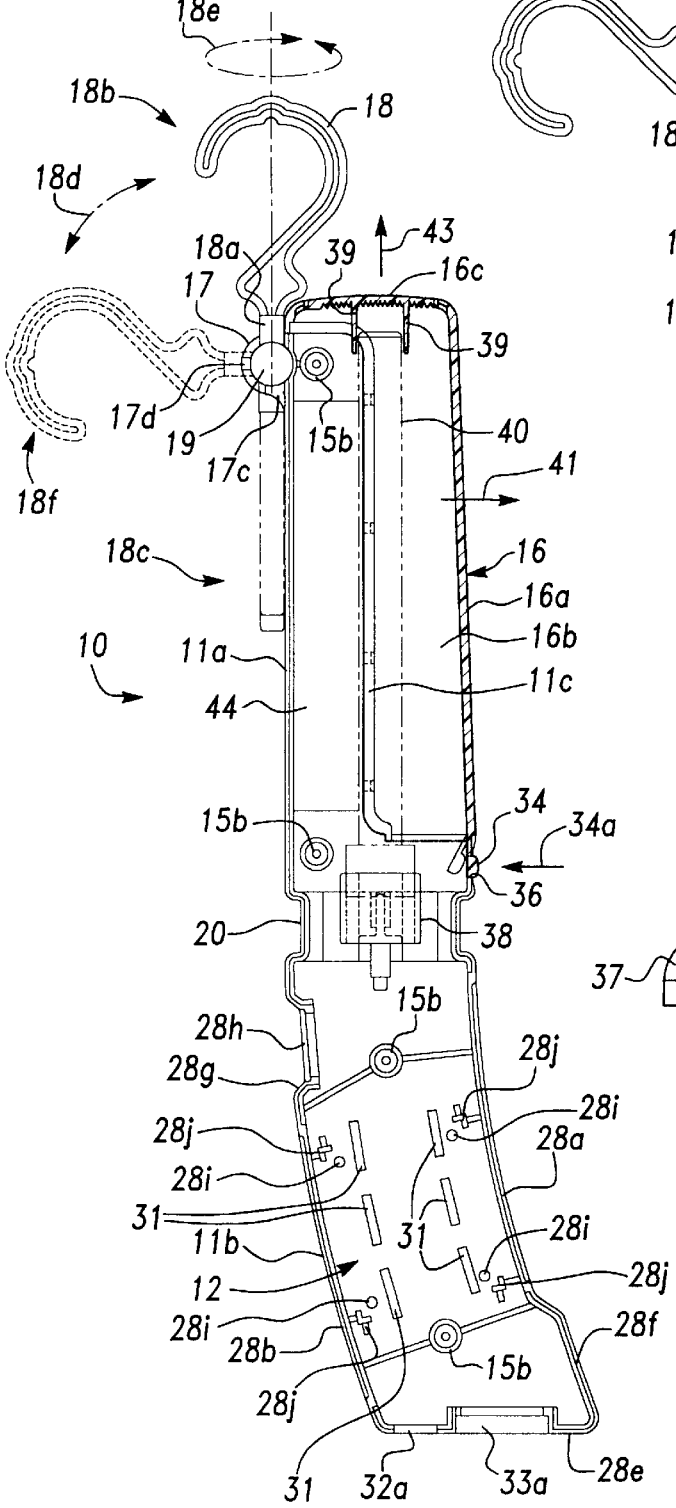
FIG. 5 is a longitudinal cross-sectional view of the utility light shown in the FIG. 1.

The lens 16 is shown in more detail in the FIG. 5 through the FIG. 7. An outwardly projecting button 34 is formed on a free end of a downwardly projecting arm 35 which extends from a bottom edge of the front wall 16*a* of the lens 16. The button 34 engages in an aperture 36 formed in a front wall of the upper light portion 11*a*. The arm 35 is flexible such that it can be bent rearwardly (see the FIG. 5) to enable the button 34 to slide inside the wall of the upper light portion 11*a* and move downwardly until the button snaps into the aperture 36. To remove the lens, the button 34 is pushed inwardly, in the direction of an arrow 34*a*, until it releases from the aperture 36 thereby permitting the lens 16 to be moved upwardly away from the upper light portion 11*a*. An upper edge 37 of the lens 16 engages an upper edge of each of the right shell 12 and the left shell 13 thereby preventing the lens from moving forward. Thus, the upper edge 37 and the button 34 cooperate to releasably secure the lens 16 to the shells 12 and 13.

A generally T-shaped lamp socket 38 (see the FIG. 4) is captured between the shells 12 and 13 internal to the body 11 in the area of the groove 20. A pair of downwardly projecting tabs 39 are formed on an inner surface at the upper end of the lens 16. A pin end of a vertically extending fluorescent lamp 40 is inserted into the socket 38 and an upper end of the lamp is retained between the tabs 39 when the cover 16 is mounted on the body 11. The lamp 40 can easily be changed by pressing the button 34 to release the lens 16 thereby exposing the lamp 40. Light from the lamp 40 is transmitted through the vertically extending walls 16*a* and 16*b* of the lens 16 as shown by an arrow 41. The upper wall 16*c* of the lens 16 has a plurality of sawtooth ridges 42 formed on an interior surface thereof. The ridges 42 tend to collect light from the lamp 40 and direct it through the upper wall 16*c* in the direction of an arrow 43. Thus, the light 10 can be used to illuminate a broad area using light exiting in the direction of the arrow 41 or can be used in a manner similar to a flashlight to direct light to a smaller area utilizing the light exiting in the direction of the arrow 43 when the hook 18 is in the storage position 18*c* or in the intermediate position 18*f*. Furthermore, a reflector 44, in the form of a flexible sheet of reflective material, can be positioned in the upper light portion 11*a* against the interior surfaces of the shells 12 and 13.

In summary, the fluorescent utility light 10 according to the present invention includes: the pair of complementary half shells 12,13 cooperating to form the substantially closed hollow body 11 having the upper light portion 11a and the lower handle portion 11*b*, the upper light portion having the opening 11*c* formed therein; the transparent lens 16 releasably attached to the body 11 and closing the upper light portion opening 11*c*; the fluorescent lamp socket 38 retained between the half shells 12,13 for receiving the lower end of the fluorescent lamp 40; and tab the retaining means 39 attached to the internal surface of the top wall 16*c* of the lens 16 for releasably retaining the upper end of the fluorescent lamp 40 received in the socket 38, the lens being removable from the body 11 for removing the fluorescent lamp from the socket and inserting another fluorescent lamp into the socket through the opening 11*c*. The fluorescent utility light 10 further includes: the lower handle portion 11*b* being curved; and the light holder clip 21 including the magnet 25 for releasably attaching the body 11 to a metallic surface, the light holder clip having a pair of legs 22 releasably engaging the circumferential groove 20 formed in the exterior of the body, the groove having a polygonal cross section providing a plurality of detent positions for the light holder clip. The lens has the plurality of sawtooth ridges 42 formed on the inner surface of the top wall 16*c* of the lens for collecting light from the fluorescent lamp 40 retained in the socket 38 and directing the collected light through the top wall. The utility light 10 includes the hook 18 having the shank portion 18*a* attached to the ball 19 and the pair of spaced apart projections 17 formed on the upper light portion 11a for retaining the ball and permitting movement of the hook, the projections having the detents 17*c*,17*d* formed therein for releasably retaining the hook in the extended position 18*b* away from the body 11, the storage position 18*c* adjacent the body and the intermediate position 18*f* between the storage position and the extended position. The half shells 12,13 have the rear surface 28*b* on the lower handle portion 11*b* and the recess 28*g* formed in the upper end of the rear surface, the recess including the aperture 28*h* formed therein for retaining the push button switch 29. The half shells 12,13 have the bottom surface 28*e* on the lower handle portion 11*b* and the pair of apertures 32*a*,33*a* formed in the bottom surface for retaining the power cord 32 and the electrical socket 33.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A fluorescent utility light comprising:

an elongated hollow body having an upper light portion extending upwardly from a lower handle portion, said upper light portion having a lens opening formed therein;

a lens releasably attached to said body and closing said lens opening, said lens having a top wall with an interior surface and a pair of spaced apart downwardly projecting tabs formed on said interior surface;

a lamp socket retained in a hollow interior of said body;

a fluorescent lamp inserted in said lamp socket and positioned adjacent said lens, said lamp having an upper end retained between said tabs, said fluorescent lamp being removable from said body through said lens opening when said lens is detached from said body;

an aperture formed in said body adjacent said lens opening;

a flexible arm extending from said lens and having a free end on which a projecting button is formed, said arm extending into said body and said button engaging said aperture to retain said lens in said lens opening whereby when said button is pushed toward said hollow interior of said body, said button releases from said aperture and said lens can be removed from said lens opening to permit removal of said fluorescent tube from said lamp socket through said lens opening.

2. The apparatus according to claim 1 wherein said lower handle portion has curved, generally parallel front and rear surfaces shaped to form a grip for a human hand.

3. The apparatus according to claim 1 wherein said lower handle portion has a bottom surface in which is formed a first aperture through which a power cord extends and a second aperture in which an electrical socket is mounted.

4. The apparatus according to claim 1 wherein said lens includes an upper edge engaging an edge of said lens opening in said body and a bottom edge from which said arm extends.

5. The apparatus according to claim 1 including a plurality of sawtooth ridges formed on said interior surface of said lens for collecting light from the fluorescent lamp and directing said collected light through said top wall.

6. The apparatus according to claim 1 wherein said body has a circumferential groove formed therein and including a light holder clip releasably retained in said groove for rotation about said body, said groove having a polygonal cross section providing a plurality of detent positions and said light holder clip having a pair of legs for engaging said groove and releasably retaining said light clip holder at each of said detent positions.

7. The apparatus according to claim 6 wherein said light holder clip includes a magnet means for releasably attaching said body to a metallic surface.

8. The apparatus according to claim 1 including a hook mounted on said upper light portion, said hook being movable between at least a storage position adjacent said body and an extended upper position away from said body.

9. The apparatus according to claims 8 wherein said hook has a shank portion attached to a ball, said upper light portion has a pair of spaced apart projections formed thereon for retaining said ball, and said projections have detents formed therein for receiving said shank and releasably retaining said hook in said storage position and said extended upper position.

10. The apparatus according to claim 1 including a reflector retained in said upper light portion and positioned to reflect light from said fluorescent lamp through said lens.

11. A fluorescent utility light comprising:

a substantially closed hollow body having an upper light portion extending from a lower handle portion, said upper light portion having a lens opening formed therein;

a lens releasably attached to said body and closing said lens opening, said lens having transparent walls including a front wall, a pair of side walls and a top wall;

a fluorescent lamp socket retained in said body;

a fluorescent lamp having a lower end received in said lamp socket and an upper end extending adjacent to said top wall of said lens, and positioned to shine light through said front wall, said side walls and said top wall of said lens, the light exiting said front wall and said side walls illuminating a relatively broad area; and a plurality of sawtooth ridges formed on an inner surface of said top wall of said lens for collecting light from said upper end of said fluorescent lamp and directing said collected light through said top wall to illuminate a relatively smaller area than the broad area.

12. A fluorescent utility light comprising:

an elongated hollow body having an upper light portion extending upwardly from a curved lower handle portion, said upper light portion having a lens opening formed therein;

a lens releasably attached to said body and closing said lens opening, said lens having a transparent top wall and at least one other transparent wall, said transparent top wall having an interior surface with a plurality of sawtooth ridges formed thereon and a pair of spaced apart tabs downwardly projecting from said interior surface;

a lamp socket retained in said body;

a fluorescent lamp inserted in said lamp socket and positioned adjacent said one other transparent wall of said lens, said lamp having an upper end retained between said tabs, said fluorescent lamp being removable from said body through said lens opening when said lens is detached from said body;

a circumferential groove formed in an exterior of said body, said groove having a polygonal cross section providing a plurality of detent positions;

a light holder clip including a magnet means for releasably attaching said body to a metallic surface, said light holder clip having a pair of legs releasably engaging said circumferential groove for selective rotation of said light holder clip about said body to each of said detent positions; and a hook mounted on said upper light portion of said body, said hook being movable between at least a storage position adjacent said body and an extended upper position away from said body whereby when said fluorescent lamp is connected to a source of electrical power, said fluorescent lamp generates light such that one portion of the light exits said body through said one other transparent wall to illuminate a relatively broad area and another portion of the light is collected by said sawtooth ridges and directed through said top wall of said lens to illuminate a relatively smaller area.

* * * * *